US011434664B2

(12) United States Patent
Huang et al.

(10) Patent No.: US 11,434,664 B2
(45) Date of Patent: Sep. 6, 2022

(54) ADJUSTABLE DOOR LOCK

(71) Applicant: TAIWAN FU HSING INDUSTRIAL CO., LTD., Kaohsiung (TW)

(72) Inventors: Chao-Ming Huang, Kaohsiung (TW); Fu-Chih Huang, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 691 days.

(21) Appl. No.: 16/292,619

(22) Filed: Mar. 5, 2019

(65) Prior Publication Data

US 2020/0173196 A1 Jun. 4, 2020

(30) Foreign Application Priority Data

Dec. 3, 2018 (TW) ..... 107216406

(51) Int. Cl.
*E05B 63/00* (2006.01)
*E05B 55/00* (2006.01)

(52) U.S. Cl.
CPC ..... *E05B 63/006* (2013.01); *E05B 55/005* (2013.01); *E05Y 2900/132* (2013.01)

(58) Field of Classification Search
CPC ..... E05B 55/005; E05B 63/006; E05B 9/08; Y10T 70/5832; Y10T 292/57; Y10T 70/7655; Y10T 70/8541; E05C 1/163; E05Y 2900/132
See application file for complete search history.

(56) References Cited

U.S. PATENT DOCUMENTS 6,412,318 B1 * 7/2002 Shen ..... E05B 47/0661 70/217
8,449,005 B1 * 5/2013 Wang ..... E05B 63/16 292/336.3
8,844,330 B2 * 9/2014 Moon ..... E05B 55/005 70/224
9,528,300 B2 * 12/2016 Moon ..... E05B 55/005
2005/0127691 A1 * 6/2005 Shen ..... E05B 15/02 292/336
2005/0218665 A1 * 10/2005 Shen ..... E05B 55/005 292/336.3
2006/0042333 A1 * 3/2006 Wu ..... E05B 55/005 70/224
2007/0096479 A1 * 5/2007 Lin ..... E05B 9/08 292/336.3
2008/0168809 A1 * 7/2008 Liu ..... E05B 55/005 70/224

(Continued)

*Primary Examiner* — Mark A Williams
(74) *Attorney, Agent, or Firm* — Rosenberg, Klein & Lee

(57) ABSTRACT

A door lock includes a main part including an axial tube and a connection tube extending on two ends thereof. A mounting plate has a mounting hole and at least one first engaging portion. A first plate has at least one second engaging portion which faces the mounting plate. Multiple first fixing members extend through the first plate and are not connected to the mounting plate. A second plate is mounted to the connection tube and includes multiple positioning holes. Multiple fastening members extend through the positioning holes and are connected to the first fixing members. The second connection portion is threadedly connected to the first connection portion to adjust a distance between the mounting plate and the main part so that the door lock can be installed to doors of different thicknesses.

9 Claims, 11 Drawing Sheets

(56) References Cited

U.S. PATENT DOCUMENTS

| | | | | |
|---|---|---|---|---|
| 2011/0006550 | A1* | 1/2011 | Cho | E05B 3/065 292/167 |
| 2012/0267903 | A1* | 10/2012 | Welsby | E05B 55/005 292/145 |
| 2013/0229021 | A1* | 9/2013 | Wang | E05B 13/004 292/336.3 |
| 2014/0196509 | A1* | 7/2014 | Moon | E05C 1/163 70/1.5 |

* cited by examiner

ADJUSTABLE DOOR LOCK

BACKGROUND OF THE INVENTION

1. Fields of the Invention

The present invention relates to a door lock, and more particularly, to a door lock wherein the distance between the mounting plate and the main part of the lock is adjustable so as to be installed to different thicknesses of doors.

2. Descriptions of Related Art

There are different types of door locks that are installed to doors that have different functions, thicknesses, material and sizes. The locks are unlocked or locked by using a correct key.

Most of the doors has a thickness between 32 mm to 60 mm, and the conventional door locks are individually made according to the specific thickness range of doors. In other words, the manufacturers have to manufacture the door locks of the same series with different parts so as to match the installation requirements to doors of different thicknesses. However, the more number of the parts are required, the higher inventory pressure is existed. On the other hand, when the customers replace doors of different thicknesses, the old door locks cannot be installed to the new doors.

Although some door locks are designed to have the adjustment feature, these door locks mostly include a complicated mechanism, and the range of adjustment is limited.

The present invention intends to provide a door lock that is easily adjusted and can be used to doors of different thicknesses.

SUMMARY OF THE INVENTION

The present invention relates to a door lock and comprises a main part including an axial tube and a connection tube extending in opposite direction from the main part. The connection tube has a first connection portion formed thereto. A latch is retractably and radially connected to the main part. A mounting plate has a mounting hole and at least one first engaging portion. The connection tube extends through the mounting hole, and the mounting hole includes a second connection portion which is connected to the connection portion. The distance between the mounting plate and the main part is adjustable by rotating the mounting plate relative to the connection portion. A first plate has at least one second engaging portion which faces the mounting plate. The first plate includes a bore through which the connection tube extends. Multiple first fixing members extend through the first plate and are not connected to the mounting plate.

Preferably, a second plate includes a through hole and the axial tube extends through the through hole of the second plate. The second plate includes multiple positioning holes and multiple fastening members extend through the positioning holes and are connected to the first fixing members of the first plate.

Preferably, the first connection portion includes outer threads and the second connection portion includes inner threads which are threadedly connected to the first connection portion. When the mounting plate is rotated, a relative position between the second connection portion and the first connection portion is adjustable.

Preferably, the fastening members are bolts, and the first fixing members are tubular members. The fastening members are axially and threadedly connected to the first fixing members.

Preferably, the at least one first engaging portion is a notch. The at least one second engaging portion is a ridge protruding from the first plate.

Preferably, the main part is located in a passage in a door. The first plate is mounted to the mounting plate and connected to one side of the door. The second plate is connected to another side of the door.

Preferably, the mounting plate includes at least one serrated portion protruding from one side thereof.

Preferably, two collars each have a recessed area, and the two collars are respectively mounted to the first and second plates. Each of the first and second plates is accommodated in the recessed area corresponding thereto.

Preferably, two sleeves are respectively mounted to the axial tube and the connection tube. Two handles each have a tubular portion, and the tubular portion is mounted to the sleeve corresponding thereto and extends through an opening defined in the collar corresponding thereto.

Preferably, the sleeves each have a radial slot and an installation slot communicates with the radial slot. A shifting part has two branches and a restriction portion which extends toward a direction opposite to the two branches. An extension extends perpendicularly from one side of the restriction portion. A shoulder is formed between the restriction portion and the outside of each branch. A fixing portion extends from a root portion between the two branches of the shifting part. The shoulder is located corresponding to the radial slot. The shifting part is inserted into each of the sleeves. A resilient member is connected to the fixing portion, and one end of the resilient member that is located opposite to the fixing portion is engaged with the installation slot. The resilient member biases the shifting part to extend the restriction portion and the extension into the radial slot. The shoulders are engaged with the inside wall of the sleeve. The tubular portion includes an engaging slot which is located corresponding to the restriction portion and the extension. The extension extends through an aperture defined in the inside wall of the engaging slot.

Preferably, a core has a driving member and the driving member is connected to the main part. The driving member is restricted by the fixing portion of the shifting part when the core is located at a locked position. When the core is located at an unlocked position, the driving member is not restricted by the fixing portion of the shifting part. The shifting part is movable and toward the resilient member.

Preferably, at least one second fixing member extends through the second plate and toward the main part. The at least one second fixing member is connected to a receiving portion on the main part.

The advantages of the present invention are that the present invention includes the mounting plate whose second connection portion is threadedly and adjustably connected to the first connection portion of the connection tube of the main part so as to be connected to doors of different thicknesses. The second engaging portion of the first plate is engaged with the first engaging portions of the mounting plate. The second fixing members extend through the second plate and are connected to the first fixing members. The present invention has a simple structure and easily assembled and dis-assembled. The manufacturers do not need to develop different locks for doors of different thicknesses.

The shifting part has the extension which makes the shifting part be easily aligned with the aperture of the handle, such that the sleeve and the core can be used in different spaces, and the handle is easily assembled and dis-assembled. The relative position between the shifting part and the aperture prevents the collars from not being able to cover the aperture when the lock is adjusted to its maximum range.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
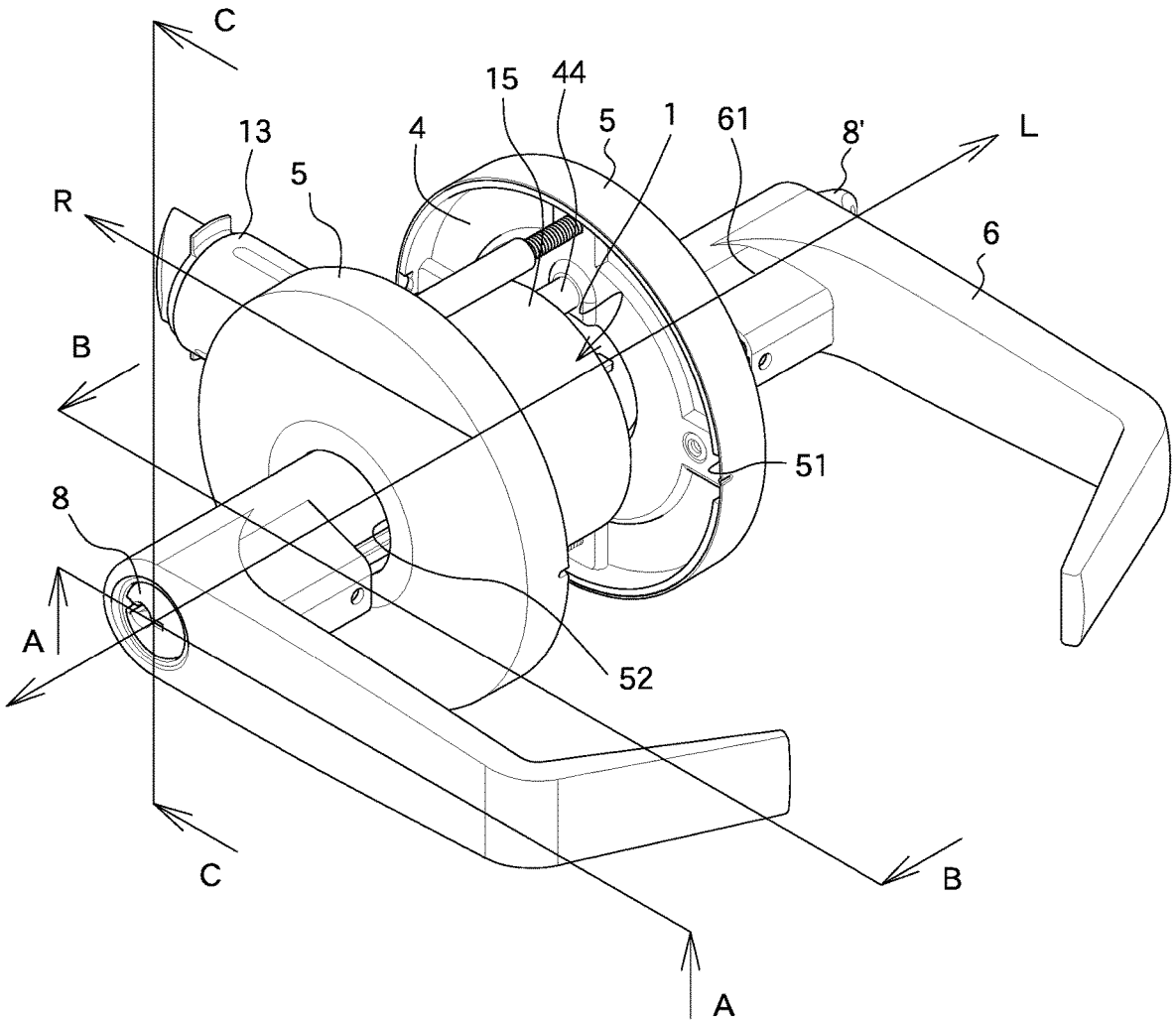
FIG. 1 is a perspective view to show the door lock of the present invention.
Figure 2:
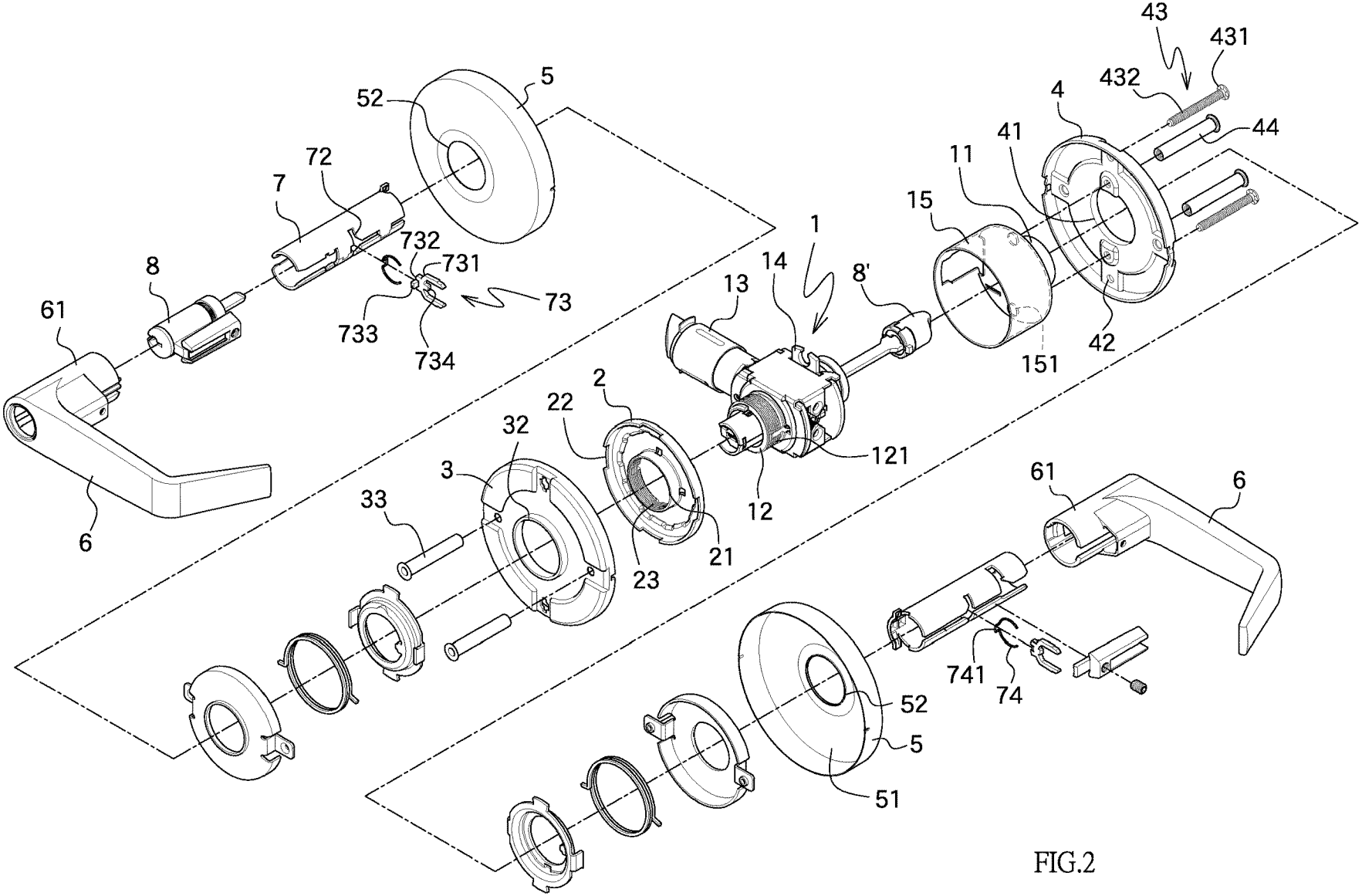
FIG. 2 is an exploded view of the door lock of the present invention.
Figure 3:
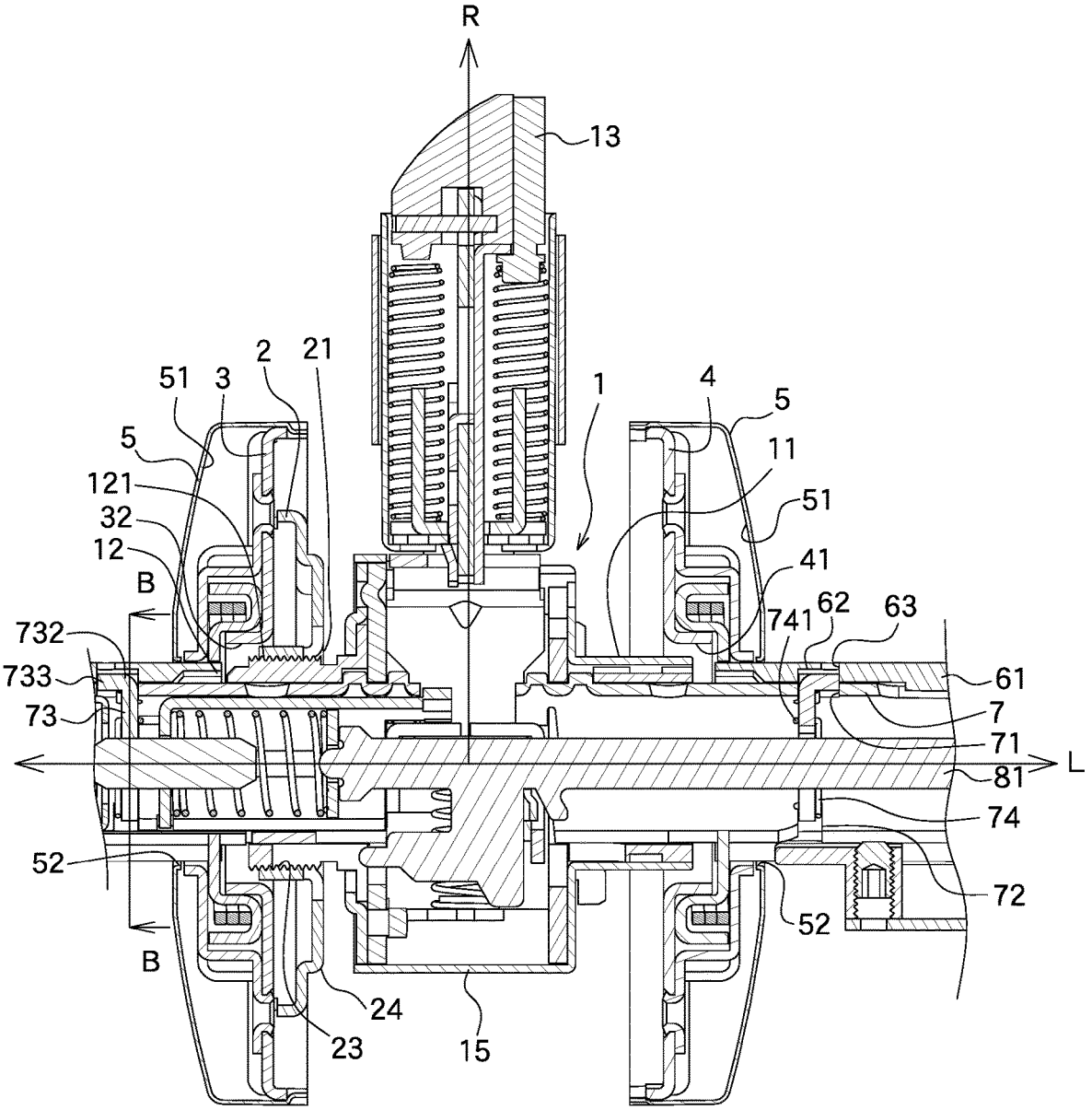
FIG. 3 is a cross sectional view, taken along line A-A of FIG. 1.

Referring to FIGS. 1 to 3, the door lock of the present invention is disclosed, and comprises a main part 1 which includes an axial tube 11 and a connection tube 12 extending in the axial direction "L" and in opposite direction from the main part 1. The connection tube 12 has a first connection portion 121 formed thereto. A latch 13 is retractably connected to the main part 1 in the radial direction "R".

A mounting plate 2 has a mounting hole 21 and at least one first engaging portion 22. The diameter of the mounting plate 2 is larger than that of the main part 1. The connection tube 12 extends through the mounting hole 21, and the mounting hole 21 includes a second connection portion 23 which is connected to the first connection portion 121. The distance in the axial direction "L" between the mounting plate 2 and the main part 1 is adjustable by rotating the mounting plate 2 relative to the first connection portion 121.

The first connection portion 121 includes outer threads and the second connection portion 23 includes inner threads which are threadedly connected to the first connection portion 121. When the mounting plate 2 is rotated, a relative position between the second connection portion 23 and the first connection portion 121 is adjustable. That is to say, the distance between the mounting plate 2 and the main part 1 is adjusted.

Figure 4:
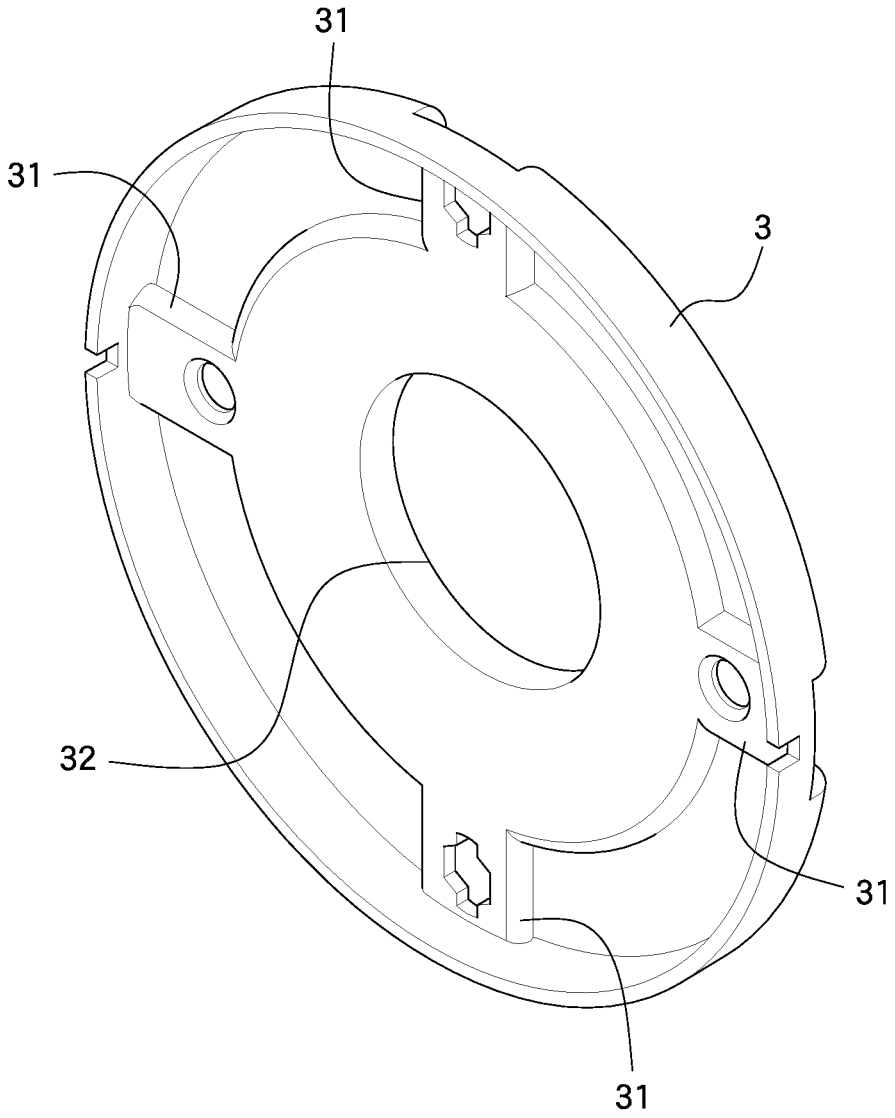
FIG. 4 shows another angle of the first plate of the door lock of the present invention.

A first plate 3 has at least one second engaging portion 31 which faces the at least one first engaging portion 22 of the mounting plate 2. The diameter of the first plate 3 is larger than that of the mounting plate 2 and the main part 1. In one embodiment, the at least one first engaging portion 22 is a notch, and the at least one second engaging portion 31 is a ridge protruding from the first plate 3. The at least one first engaging portion 22 is a notch that is defined along the periphery of the mounting plate 2, and the at least one second engaging portion 31 is a ridge protruding from the first plate 3 as shown in FIG. 4. The ridge is engaged with the notch so that the two parts are rotated in the same direction. Alternatively, the at least one first engaging portion 22 can be a ridge, and the at least one second engaging portion 31 can be a notch. The first plate 3 includes a bore 32 through which the connection tube 12 extends. Multiple first fixing members 33 extend through the first plate 3 and are not connected to the mounting plate 2.

A second plate 4 includes a through hole 41 and the axial tube 11 extends through the through hole 41 of the second plate 4. The diameter of the second plate 4 is larger than that of the main part 1. The second plate 4 includes multiple positioning holes 42 and multiple fastening members 43 extend through the positioning holes 42 and are connected to the first fixing members 33 of the first plate 3. In one embodiment, the fastening members 43 each include a head 431 and a fastening portion 432, wherein the diameter of the head 431 is larger than that of the positioning hole 42 corresponding thereto. The fastening portion 432 extends through the positioning hole 42 and is fixedly connected to the first fixing member 33 corresponding thereto. In one embodiment, the fastening members 43 are bolts, and the first fixing members 33 are tubular members. The fastening members 43 are axially and threadedly connected to the first fixing members 33. Because the mounting plate 2 is able to be adjusted the distance between the mounting plate 2 and the second plate 4, so that the length of the first fixing members 33 and the fastening members 43 is made to be long enough to be connected to each other when a maximum distance between the mounting plate 2 and the second plate 4 is formed, and when the second connection portion 23 is threadedly connected to the first connection portion 121 with only few threads.

At least one second fixing member 44 extends through the second plate 4 and toward the main part 1. The at least one second fixing member 44 is connected to a receiving portion 14 on the main part 1. The main part 1 includes a housing 15 to protect the latch 13 of the door lock, and the receiving portion 14 is connected to the housing 15. Preferably, the receiving portion 14 is located in the housing 15. The housing 15 includes a connection hole 151 through which the at least one second fixing member 44 extend. The at least one second fixing member 44 can be integrally formed with the second plate 4 or can be connected to the second plate 4. Therefore, the second plate 4 is axially and stably connected to the main part 1, by the connection between the at least one second fixing members 44 and the receiving portion 14, and the second plate 4 is prevented from shifting or rotating by any force applied thereto.

In order to protect the main part 1, the second plate 4, the mounting plate 2, and the first plate 3, in one embodiment, there are two collars 5 respectively mounted to the first and second plates 3, 4. Each collar 5 has a recessed area 51 that faces the main part 1, and the first and second plates 3, 4 are respectively accommodated in the two respective recessed areas 51 of the two collars 5. Each collar 5 includes an opening 52.

In order to unlock or lock the door lock, two handles 6 are installed to the door lock, and the handles 6 can be rotated to unlock or lock the door lock. Two sleeves 7 are respectively mounted to the axial tube 11 and the connection tube 12 via the opening 52. The handles 6 each can be an L-shaped or ball-shaped. Each handle 6 has a tubular portion 61, and the tubular portion 61 is mounted to the sleeve 7 corresponding thereto and extends through the opening 52 defined in the collar 5 corresponding thereto.

Preferably, the sleeves 7 each have a radial slot 71 and an installation slot 72 communicates with the radial slot 71. A Y-shaped shifting part 73 is located in each sleeve 7, and has two branches and a restriction portion 732 which extends toward a direction opposite to the two branches. An extension 733 extends perpendicularly from one side of the restriction portion 732. A shoulder 731 is formed between the restriction portion 732 and the outside of each branch. A fixing portion 734 extends from a root portion between the two branches of the shifting part 73. The shoulder 731 is located corresponding to the radial slot 71. A resilient member 74 is connected to the fixing portion 734, and one end of the resilient member 74 that is located opposite to the fixing portion 734 is engaged with the installation slot 72. The resilient member 74 biases the shifting part 73 to extend the restriction portion 732 and the extension 733 into the radial slot 71. The shoulders 731 are engaged with the inside wall of the sleeve 7. In one embodiment, the resilient member 74 is C-shaped part and has a bent portion 741 on the top thereof so as to be connected to the fixing portion 734.

Figure 5:
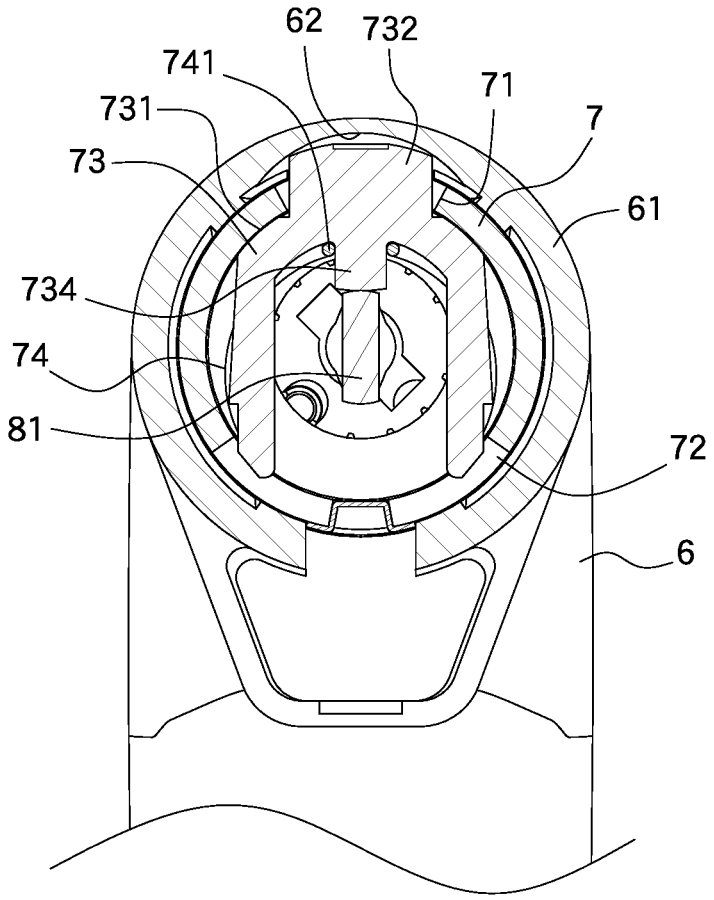
FIG. 5 is a cross sectional view, taken along line B-B of FIGS. 1 and 3.
Figure 6:
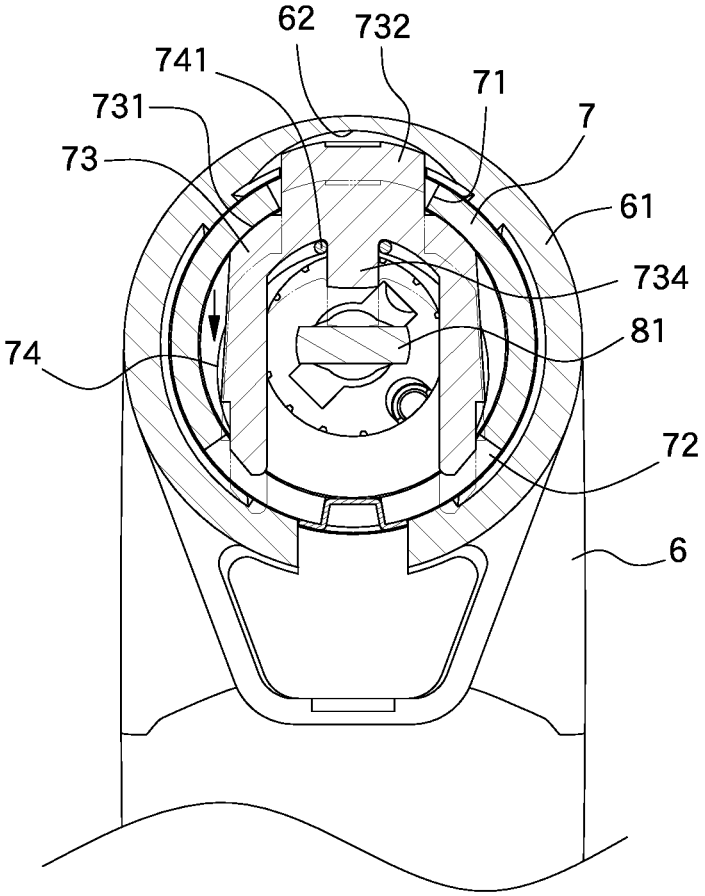
FIG. 6 is a cross sectional view, taken along line B-B of FIGS. 1 and 3, and also shows that the restriction portion of the shifting part is separated from the engaging slot.

The tubular portion 61 includes an engaging slot 62 which is located corresponding to the restriction portion 732 and the extension 733. The extension 733 extends through an aperture 63 defined in the inside wall of the engaging slot 62. The aperture 63 is located to face outside of the collar 5 and opposite to the main part 1. The extension 733 is located aligned to the aperture 63 so that the sleeve 7 and the core 8/8' are conveniently installed, and makes the handle 6 to be easily assembled and dis-assembled. When the shifting part 73 is not yet pressed, the restriction portion 732 and the extension 733 are located at the positions as shown in FIGS. 3 and 5. When a tool is inserted into the aperture 63 and presses the extension 733 as shown in FIG. 6, the shifting part 73 is moved and disengaged from the engaging slot 62, such that the tubular portion 61 is axially removed from the sleeve 7. It is noted that the position of the aperture 63 cannot be seen in FIGS. 5 and 6, and only a portion of the engaging slot 62 can be seen.

The door lock is locked or unlocked by using the cores 8, 8' to transmit main part 1. In one embodiment, the core 8/8' is installed in the sleeve 7 and the distal end of the core 8/8' is exposed beyond the handle 6, and the other end of the core 8/8' is connected to the main part 1 via the opening 52, the through hole 41 and the axial tube 11, or via the mounting hole 21, bore 32 and the connection tube 12. The core 8/8' can be a lock cylinder or a knob-type cylinder. In one embodiment, the core 8 is a lock cylinder that is located at outside of the door, and the core 8' is a knob-type cylinder that is located at inside of the door. The core 8 has to be unlocked by using a correct key, and the core 8' can be unlocked simply by rotating the knob.

In order to prevent the handle 6 from being removed by pressing the shifting part 73 via the aperture 63 when the door locked is in unlocked status, the core 8/8' has a driving member 81 and the driving member 81 is connected to the main part 1. When the core 8 is located at a locked position as shown in FIG. 5, the driving member 81 is restricted by the fixing portion 734 of the shifting part 73 so that the shifting part 73 cannot be moved. When the core 8 is located at an unlocked position as shown in FIG. 6, the driving member 81 is not restricted by the fixing portion 734 of the shifting part 73. The shifting part 73 is movable and toward the resilient member 74. The driving member 81 is a rectangular member to achieve the above mentioned purposes.

Figure 7:
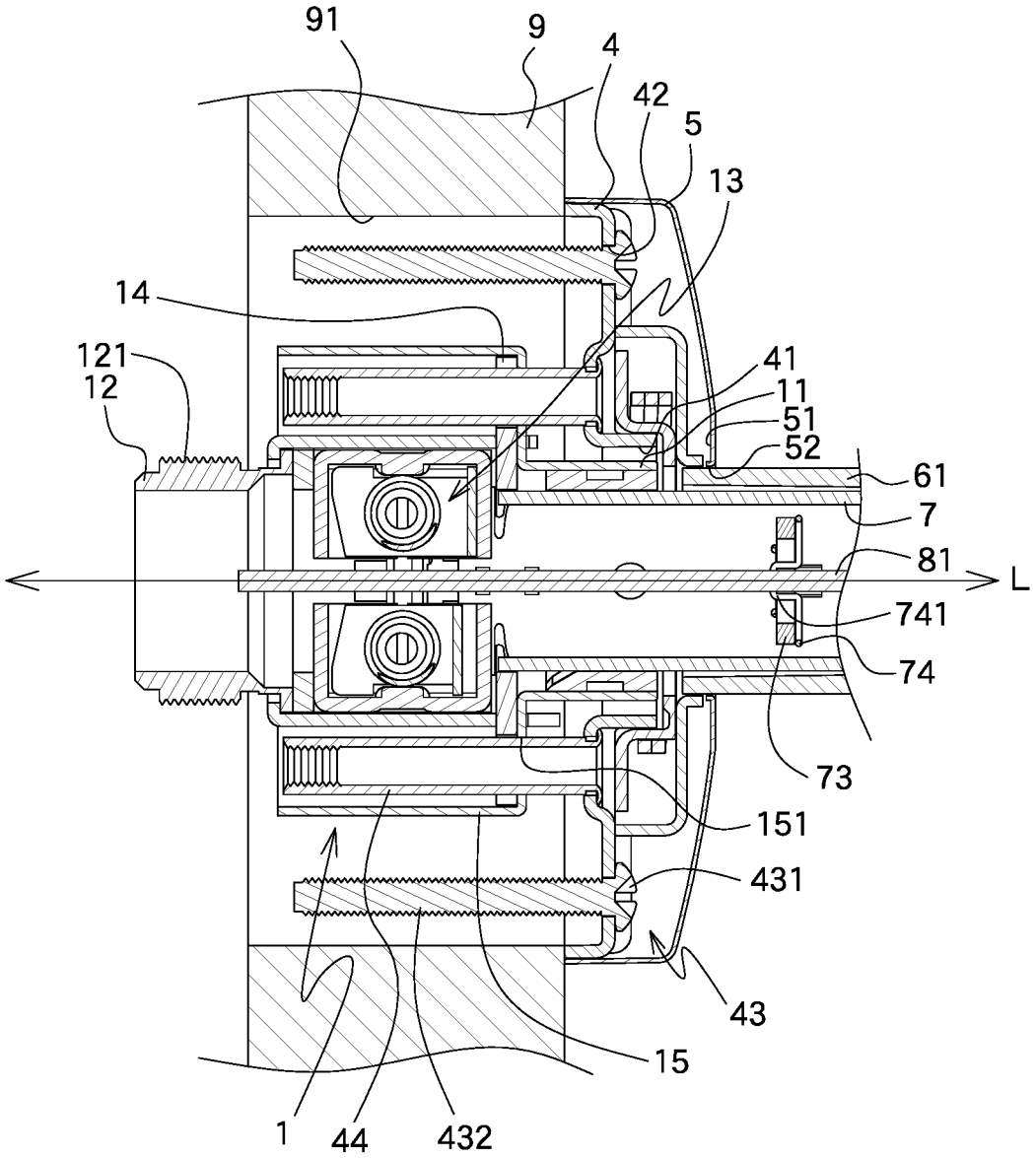
FIG. 7 is a cross sectional view, taken along line C-C of FIG. 1, and also shows that the lock has one end thereof connected to the door.
Figure 8:
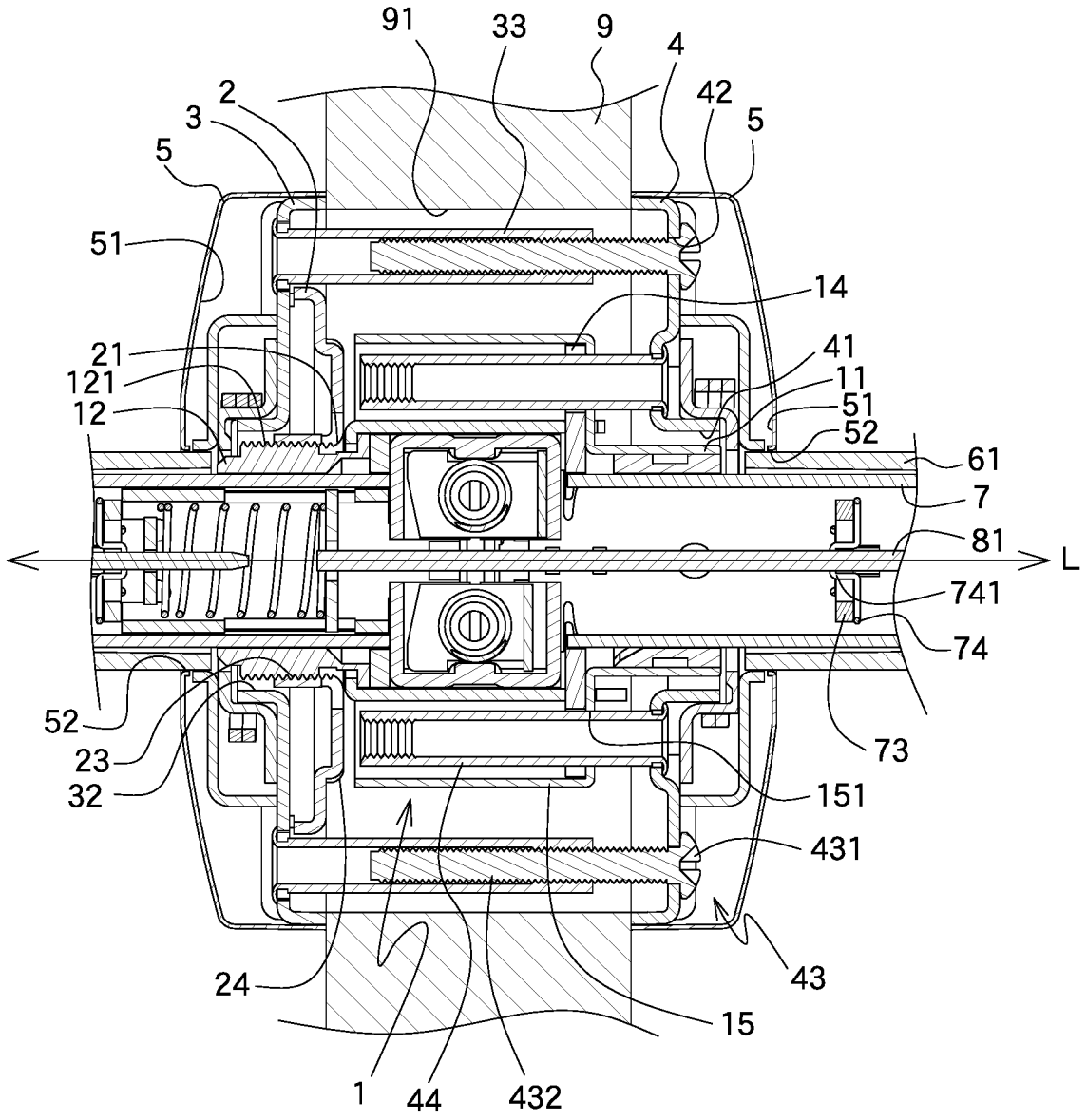
FIG. 8 is a cross sectional view, taken along line C-C of FIG. 1, and also shows that the lock is connected to the door.
Figure 9:
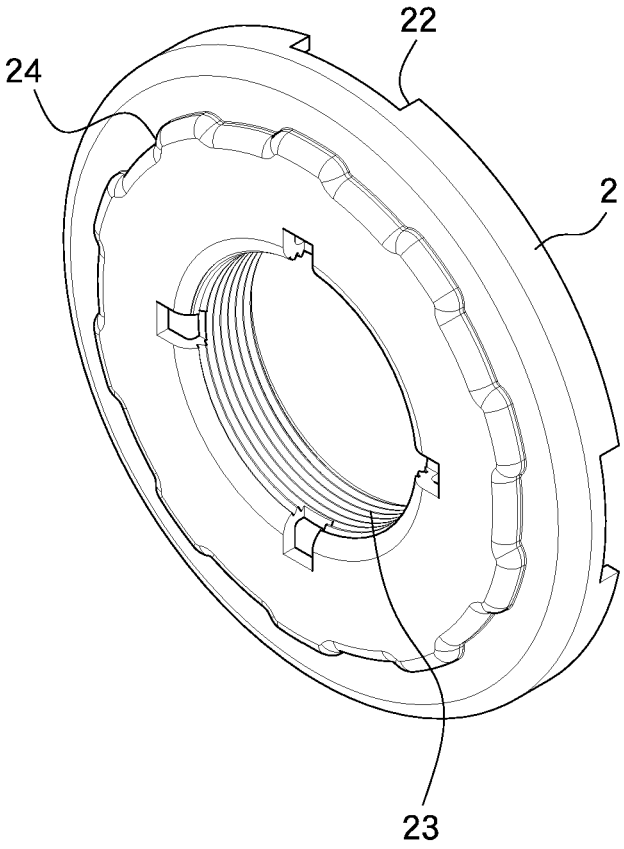
FIG. 9 shows another angle of the mounting plate of the door lock of the present invention.

As shown in FIGS. 3, 7 and 8, the main part 1 is located in a passage 91 of a door 9. The latch 13 is located in a hole (not shown) in the door 9 that communicates with the passage 91. The latch 13 does not protrude beyond the hole when the door lock is unlocked. The latch 13 protrudes beyond the hole when the door lock is locked. The first plate 3 is mounted to the mounting plate 2 and connected to one side of the door 9. The second plate 4 is connected to another side of the door 9. The diameter of the second plate 4 and the mounting plate 2 is larger than that of the passage 91. The door 9 is sandwiched between the second plate 4 and the mounting plate 2. As shown in FIG. 7, when installing the door lock to a door 9, the main part 1 is pre-connected to one side of the second plate 4 so that when the second plate 4 contacts the door 9, the main part 1 can be inserted into the passage 91. As shown in FIG. 8, the second connection portion 23 of the mounting plate 2 is connected to the first connection portion 121, and the distance between the mounting plate 2 and the main part 1 can be adjusted according to the thickness of the door 9. The mounting plate 2 is locked to contact the door 9, and the thickness of the door 9 is equal to the distance between the mounting plate 2 and the second plate 4. As shown in FIG. 9, in one embodiment, the mounting plate 2 includes at least one serrated portion 24 protruding from one side thereof so that when the second connection portion 23 of the mounting plate 2 is connected to the first connection portion 121, a tool is engaged with the at least one serrated portion 24 as shown in FIG. 8 to rotate the mounting plate 2 and the second connection portion 23 to control the relative position between the second connection portion 23 of the mounting plate 2 and the first connection portion 121.

After the mounting plate 2 contacts the door 9, the first plate 3 is connected to the mounting plate 2, and the at least one first engaging portion 22 is engaged with the at least one second engaging portion 31. Then the fastening members 43 are connected to the first fixing members 33. The head 431 of each fastening member 43 contacts against the second plate 4 so that the first plate 3 is securely connected to the second plate 4 by the fastening members 43. The first plate 3 is axially connected to the second plate 4 and cannot be rotate by the connection between the at least one first engaging portion 22 and the at least one second engaging portion 31. Therefore, the first plate 3 does not loose and removed from the first connection portion 121.

Figure 10:
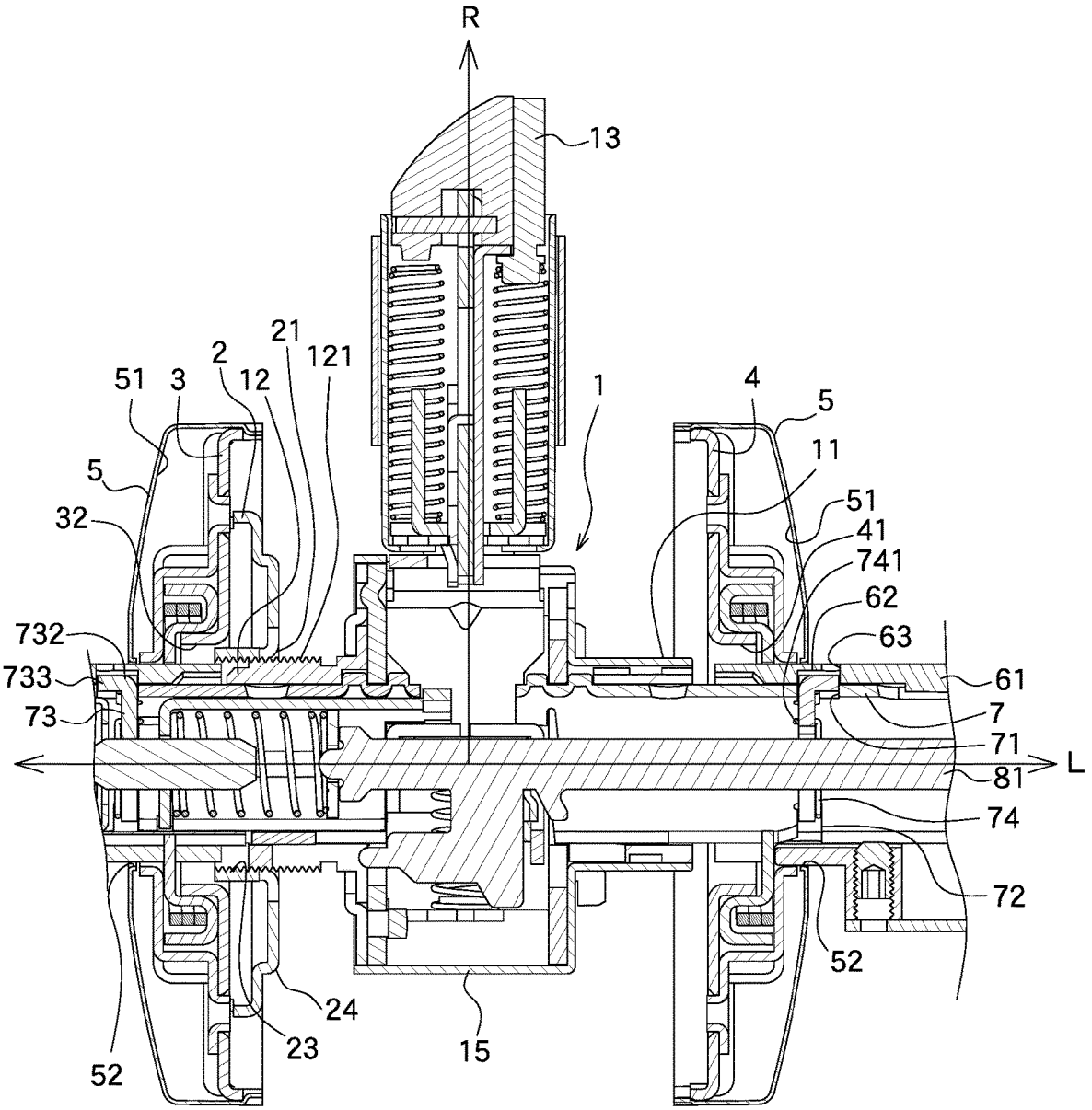
FIG. 10 is a cross sectional view, taken along line A-A of FIG. 1, and also shows that the lock is adjusted to its largest scale to be connected to a door with a large thickness.
Figure 11:
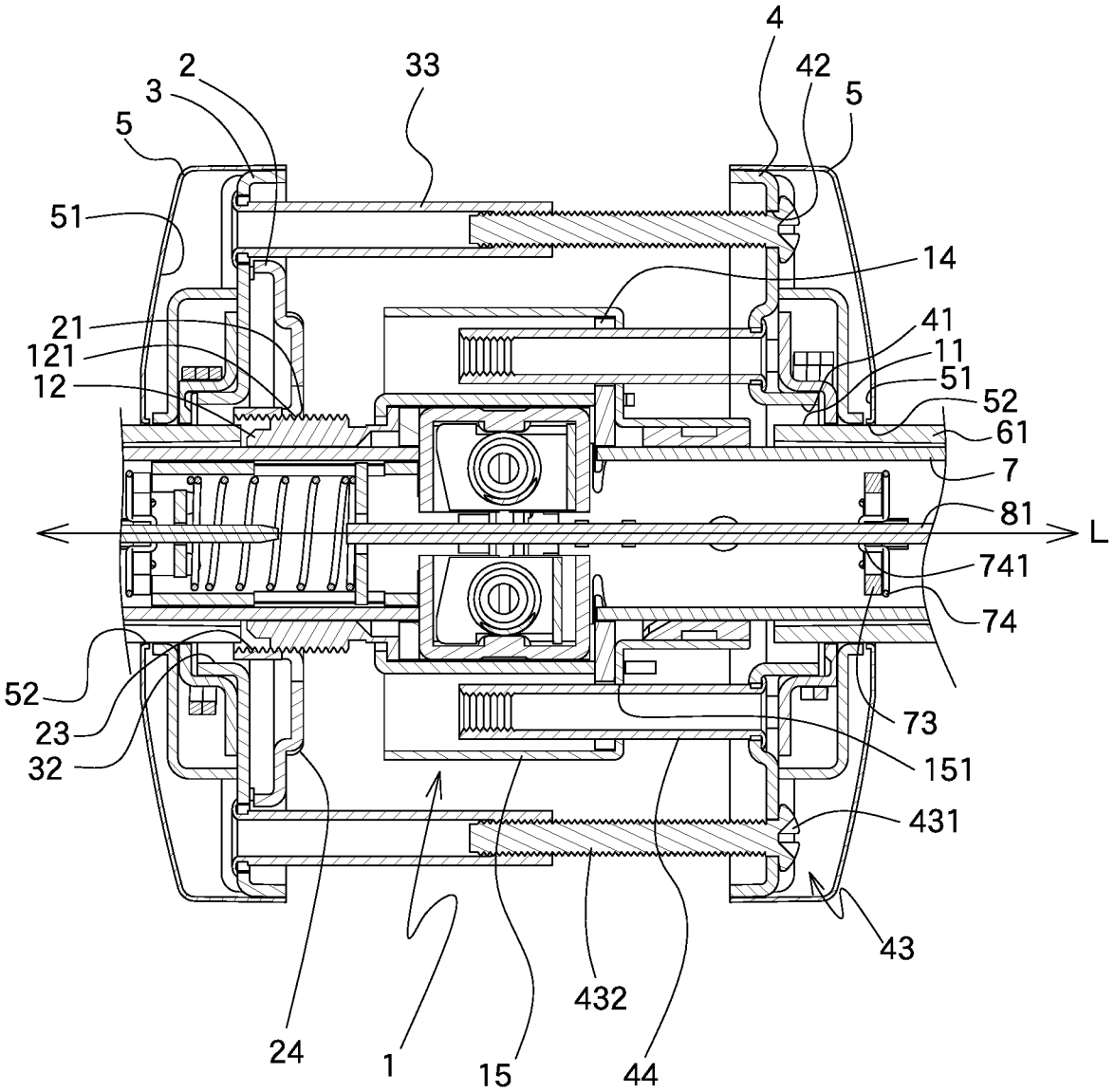
FIG. 11 is a cross sectional view, taken along line C-C of FIG. 1, and also shows that the lock is adjusted to its largest scale to be connected to a door with a large thickness.

As shown in FIGS. 10 and 11, when the door has a thick thickness, the second connection portion 23 of the mounting plate 2 is connected to the first connection portion 121 to install the mounting plate 2 to contact the door 9. The distance between the mounting plate 2 and the second plate 4 is adjustable so as to meet the thickness of the door 9. On the contrary, when the thickness of the door 9 is thin, the installation of the door lock is similar.

It is noted that when a maximum distance between the mounting plate 2 and the second plate 4 is reached, the aperture 63 is still exposed and does not covered by the collar 5, so that the shifting part 73 and the aperture 63 are located at the door lock and are opposite to the collar 5. Therefore, the aperture 63 is still exposed and does not covered by the collar 7 when the door lock is installed to a thick door, and the handle 6 can successfully assembled and dis-assembled.

While we have shown and described the embodiment in accordance with the present invention, it should be clear to those skilled in the art that further embodiments may be made without departing from the scope of the present invention.

What is claimed is:

1. A door lock comprising:

a main part including an axial tube and a connection tube both extending axially from the main part in opposite directions, the connection tube having a first connection portion formed thereon, a latch retractably and radially connected to the main part;

a mounting plate having at least one first engaging portion and a mounting hole with a second connection portion formed therein, the connection tube extending through the mounting hole, the second connection portion being connected to the first connection portion, a distance between the mounting plate and the main part being adjustable responsive to rotation of the mounting plate relative to the connection tube;

a first plate having at least one second engaging portion which faces the mounting plate, the first plate including a bore through which the connection tube extends, multiple first fixing members extending through the first plate and being devoid of a connection to the mounting plate;

a second plate having a through hole formed therein and the axial tube extends through the through hole of the second plate;

two sleeves respectively mounted to the axial tube and the connection tube, and two handles each having a tubular portion mounted to a respective one of the sleeves and extending through an opening defined in a collar corresponding thereto, the sleeves each have a radial slot and an installation slot communicating with the radial slot, a shifting part has two branches and a restriction portion extending in a direction opposite to a direction of the two branches, an extension extends perpendicularly from one side of the restriction portion, a shoulder being formed between the restriction portion and each of the two branches, a fixing portion extends from a root portion between the two branches of the shifting part, the shoulder being located in correspondence with the radial slot, the shifting part being inserted into each of the sleeves, a resilient member being connected to the fixing portion, an end of the resilient member located opposite to the fixing portion being engaged with the installation slot, the resilient member biases the shifting part to extend the restriction portion and the extension into the radial slot, the shoulders being engaged with an inside wall of the sleeve, the tubular portion includes an engaging slot located in correspondence to the restriction portion and the extension, the extension being aligned and in open communication with an aperture defined in an inside wall of the engaging slot; and a driving member axially extending through the two sleeves, the driving member being coupled to a lock core on one end thereof and being configured to contact the fixing portion of each shifting part in a locked position to block displacement thereof and be spaced from the fixing portion of each shifting part in an unlocked position to unblock displacement of the shifting parts.

2. The door lock as claimed in claim 1, wherein the second plate includes multiple positioning holes and multiple fastening members extend through the positioning holes and are connected to the first fixing members of the first plate.

3. The door lock as claimed in claim 1, wherein the first connection portion includes outer threads and the second connection portion includes inner threads which are threadedly connected to the first connection portion, when the mounting plate is rotated, a relative position between the second connection portion and the first connection portion is adjustable.

4. The door lock as claimed in claim 1, wherein the fastening members are bolts, the first fixing members are tubular members and the fastening members are axially and threadedly connected to the first fixing members.

5. The door lock as claimed in claim 1, wherein the at least one first engaging portion is a notch, the at least one second engaging portion is a ridge protruding from the first plate.

6. The door lock as claimed in claim 1, wherein the main part is located in a passage in a door, the first plate is mounted to the mounting plate and connected to one side of the door, the second plate is connected to another side of the door.

7. The door lock as claimed in claim 1, wherein the mounting plate includes at least one serrated portion protruding from one side thereof.

8. The door lock as claimed in claim 1, wherein at least one second fixing member extends through the second plate and toward the main part, the at least one second fixing member is connected to a receiving portion on the main part.

9. A door lock comprising:

a main part including an axial tube and a connection tube both extending axially from the main part in opposite directions, the connection tube having a first connection portion formed thereon, a latch retractably and radially connected to the main part;

a mounting plate having at least one first engaging portion and a mounting hole with a second connection portion formed therein, the connection tube extending through the mounting hole, the second connection portion being connected to the first connection portion, a distance between the mounting plate and the main part being adjustable responsive to rotation of the mounting plate relative to the connection tube;

a first plate having at least one second engaging portion which faces the mounting plate, the first plate including a bore through which the connection tube extends;

a second plate having a through hole formed therein and the axial tube extends through the through hole of the second plate, the second plate includes multiple positioning holes;

two sleeves respectively mounted to the axial tube and the connection tube and two handles each being coupled to a corresponding one of the sleeves, a lock core disposed in one of the sleeves and having one end thereof exposed through an opening in a corresponding one of the two handles, the lock core being coupled to the latch through a connection to the main part, wherein the latch is extended responsive to the lock core being in a locked position and the latch is retracted responsive to the lock core being in an unlocked position; and multiple first fixing members extending through the first plate and being devoid of a connection to the mounting plate and multiple fastening members extend through the positioning holes of the second plate and are connected to the first fixing members of the first plate, wherein a distance between diametrically opposed first fixing members is greater than a diameter of the mounting plate, whereby the first plate is displaceable from proximity to the mounting plate without removal of the handles from the sleeves and the mounting plate then rotated to adjust the distance between the main part and the mounting plate.

* * * * *